United States Patent [19]

Aoki et al.

[11] 4,334,011

[45] Jun. 8, 1982

[54] COLOR PHOTOGRAPHIC LIGHT SENSITIVE MATERIALS

[75] Inventors: Kozo Aoki; Yoshio Seoka; Yukio Yokota, all of Minami-ashigara, Japan

[73] Assignee: Fuji Photo Film Co., Ltd., Kanagawa, Japan

[21] Appl. No.: 213,513

[22] Filed: Dec. 5, 1980

[30] Foreign Application Priority Data

Dec. 5, 1979 [JP] Japan ..... 54-157729

[51] Int. Cl.[3] ..... G03C 1/40

[52] U.S. Cl. ..... 430/552; 430/553

[58] Field of Search ..... 430/384, 385, 472, 473, 430/552, 553

[56] References Cited

U.S. PATENT DOCUMENTS

| | | | |
|---|---|---|---|
| 2,367,531 | 1/1945 | Salminen et al. | 430/552 |
| 2,369,929 | 2/1946 | Vittum et al. | 430/552 |
| 2,536,010 | 12/1950 | Schmidt et al. | 430/473 |
| 4,124,396 | 11/1978 | Osborn | 430/553 |
| 4,254,212 | 3/1981 | Yagihara et al. | 430/553 |
| 4,264,722 | 4/1981 | Yagihara et al. | 430/553 |

*Primary Examiner*—J. Travis Brown

*Attorney, Agent, or Firm*—Sughrue, Mion, Zinn, Macpeak and Seas

[57] ABSTRACT

Color photographic light sensitive materials are disclosed, comprising a cyan dye forming coupler represented by formula (I)

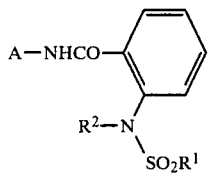

(I)

wherein A represents a cyan coupler residue, but the —NHCO group does not bond to A in the active position of A, $R^1$ represents a substituted or unsubstituted alkyl group or a substituted or unsubstituted aryl group, $R^2$ represents hydrogen or a substituted or unsubstituted alkyl group, and the various positions of the phenyl group of the formula (I) may be substituted with from 1 to 3 substituents selected from the group consisting of hydrogen, a halogen atom, an alkyl group or an alkoxy group.

11 Claims, No Drawings

COLOR PHOTOGRAPHIC LIGHT SENSITIVE MATERIALS

BACKGROUND OF THE INVENTION

The present invention relates to color photographic light sensitive materials containing a novel cyan dye forming coupler.

When color development is carried out after a silver halide photographic light sensitive material is exposed to light, an oxidized aromatic primary amine developing agent reacts with dye forming couplers to form color images. In this process generally, color reproduction by a subtractive process is utilized, by which dye images of cyan, magenta and yellow, which are complement colors of red, green and blue, respectively, are formed for reproduction of red, green and blue. For example, as cyan dye forming couplers, various phenols and naphthols have been known.

Generally, in positive type light sensitive materials to be observed directly (e.g., color paper, color positive, or color slide, etc.), phenols are often used from the view-point of color reproduction. It has been desired to improve these phenols, because those giving good color reproduction are often inferior in the fastness of color images. On the other hand, phenols which form dye images having good fastness often do not have absorption characteristics suitable for color reproduction. In order to improve these drawbacks, it is necessary in the latter case that the phenols are modified so as to show adsorption characteristics suitable for color reproduction without damaging the fastness of color images.

For the purpose of satisfying the above described requirements, it has been known to introduce a chlorine atom into the 6-position of 2-acylaminophenol cyan couplers, as described in U.S. Pat. No. 2,367,531, but fastness with respect to heat of such color images shows remarkable deterioration. Furthermore, it has been known to introduce a fluorinated carbonamido group into the 2-position of 2,5-diacylaminophenol cyan couplers as described in U.S. Pat. No. 2,895,826, but fastness with respect to light of such color images shows remarkable deterioration.

SUMMARY OF THE INVENTION

An object of the present invention is to provide couplers which are excellent in fastness and in color reproduction, by which the above described drawbacks are overcome.

It has been found that the above described object can be attained if an o-sulfonamidobenzoylamino group is introduced into a nucleus of certain cyan couplers, by which the couplers of the present invention are formed, having excellent characteristics in that they form a suitable color hue for color reproduction while also providing high fastness of color images.

Furthermore, the couplers of the present invention are also advantageous in that the lowering of the density is small in case of processing with a bleaching solution having a weak oxidation ability or a fatigued bleaching solution.

More particularly, the object of the present invention has been attained by using couplers represented by formula (I).

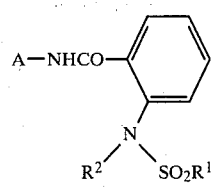

(I)

In the formula, A represents a cyan coupler residue, but the —NHCO group does not bond to A in the active coupling position of A, $R^1$ represents a substituted or unsubstituted alkyl group or aryl group, $R^2$ represents hydrogen or a substituted or unsubstituted alkyl group, and the various positions of the phenyl group of the formula (I) may be substituted with from 1 to 3 substituents selected from the group consisting of hydrogen, a halogen atom, an alkyl group, or an alkoxy group.

DETAILED DESCRIPTION OF THE INVENTION

A represents a phenol cyan coupler residue and a naphthol cyan coupler residue. $R^1$ preferably represents a substituted or unsubstituted alkyl group having from 1 to 22 carbon atoms or a substituted or unsubstituted aryl group having 6 to 22 carbon atoms, $R^2$ preferably represents hydrogen or a substituted or unsubstituted alkyl group having from 1 to 22 carbon atoms, and the various positions of the phenyl group of the formula (I) may be substituted with from 1 to 3 substituents selected from the group consisting of hydrogen, a halogen atom (for example, a fluorine atom, a chlorine atom or a bromine atom), an alkyl group having 1 to 22 carbon atom (for example, a methyl group, a butyl group or a pentadecyl group, etc.) or an alkoxy group (for example, a methoxy group, an ethoxy group or a 2-ethylhexyloxy group, etc.).

The substituents of the alkyl groups and aryl groups represented by $R^1$ and $R^2$ are selected from a halogen atom, a nitro group, a cyano group, an aryl group (for example, a phenyl group, a naphthyl group, etc.), an alkoxy group (for example, a methoxy group, an ethoxy group, etc.), an aryloxy group (for example, a phenyloxy group, a naphthyloxy group, etc.), a carboxy group, an alkylcarbonyl group (for example, an acetyl group, a tetradecanoyl group, etc.), an arylcarbonyl group (for example, a benzoyl group, etc.), an alkoxycarbonyl group (for example, a methoxycarbonyl group, a benzyloxycarbonyl group, etc.), an aryloxycarbonyl group (for example, a phenyloxycarbonyl group, a p-tolyloxycarbonyl group, etc.), an acyloxy group (for example, an acetyloxy group, a tetradecanoyloxy group, etc.), a sulfamoyl group (for example, an N-ethylsulfamoyl group, an N-octadecylsulfamoyl group, etc.), a carbamoyl group (for example, an N-ethylcarbamoyl group, an N-methyl-N-dodecylcarbamoyl group, etc.), an acylamino group (for example, an acetylamino group, a benzamido group, etc.), a diacylamino group (for example, a succinimido group, a hydantoinyl group, etc.), a ureido group (for example, a methyl ureido group, a phenylureido group, etc.), an arylamino group (for example, a (4-methoxyphenyl-)amino group, etc.), an N-alkylamilino group (for example, an N-methylanilino group, an N-butylanilino group, etc.), an N-acylanilino group (for example, an N-acetylanilino group, an N-trichloroacetylanilino group, etc.), a hydroxy group, and a mercapto group, etc. Multiple substituents may be present.

Examples of $R^1$ include a methyl group, a butyl group, a methoxyethyl group, a dodecyl group, a phenoxypropyl group, a p-chlorophenoxybutyl group, a p-tolyl group, a p-dodecylphenyl group, a p-chlorophenyl group, and a naphthyl group. Examples of $R^2$ include a methyl group, a butyl group, an octyl group, a hexadecyl group, a 2-chloroethyl group, and a 2-methoxyethyl group.

Among the cyan coupler residues represented by A, preferred residues are phenol cyan coupler residues represented by formula (II).

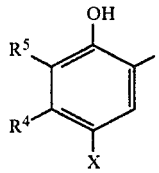

(II)

In the formula (II), $R^4$ represents a substituted or unsubstituted alkyl group, alkylacylamino group, or arylacylamino group, wherein the substituents are the same as those of the alkyl group represented by $R^1$ as described above. Examples of the alkyl group include a methyl group, an ethyl group, a butyl group, a pentadecyl group, a phenylthiomethyl group and a chloromethyl group. Examples of the alkylacylamino group include a butyrylamino group, a pivaloylamino group and a 2-(2',4'-di-tert-amylphenoxy)butanamido group. An example of the arylacylamino group includes a benzoylamino group.

$R^5$ represents hydrogen or a halogen atom (a fluorine atom, chlorine atom or bromine atom). X represents a group capable of being released by an oxidation coupling reaction with a developing agent (for example, hydrogen, a halogen atom, an alkoxy group, an aryloxy group, an acyloxy group, an imido group, a sulfonamido group or a thiocyano group, etc.).

As a particularly preferred $R^4$, there is a substituted or unsubstituted alkylacylamino group.

Hydrogen is particularly preferred as $R^5$.

Examples of such couplers included in the scope of the present invention are described below, but the couplers are not limited thereto.

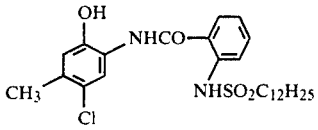

(1)

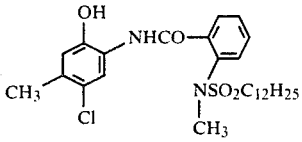

(2)

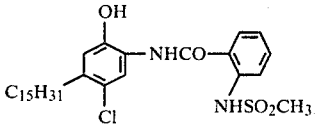

(3)

-continued

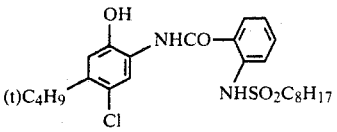

(4)

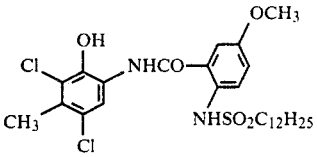

(5)

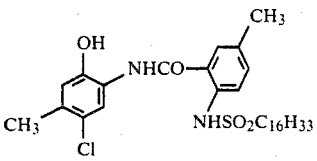

(6)

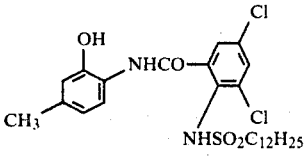

(7)

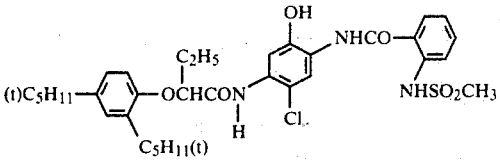

(8)

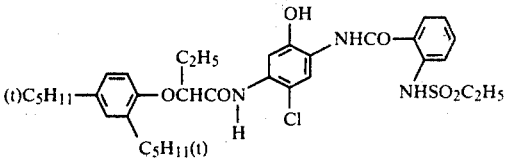

(9)

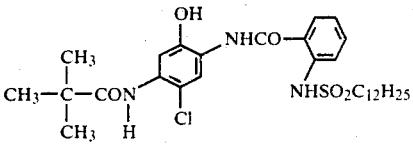

(10)

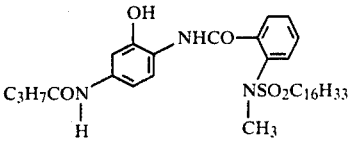

(11)

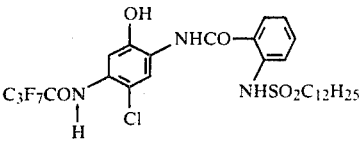

(12)

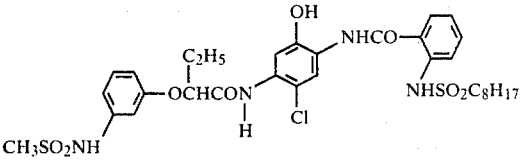

(13)

-continued (14)

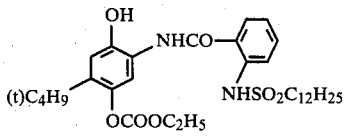

(15)

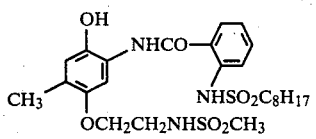

(16)

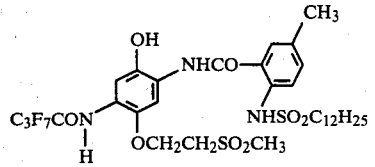

(17)

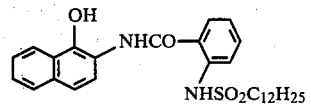

(18)

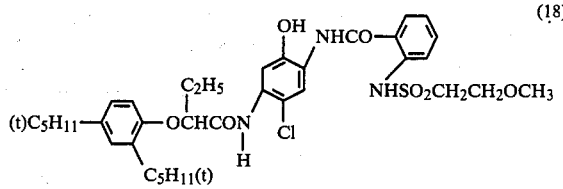

(19)

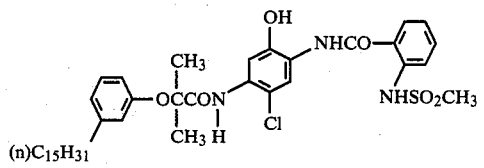

(20)

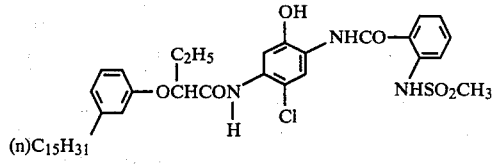

Compounds according to the present invention can be synthesized by processes as described below.

Anthranilic acid ester is condensed with corresponding sulfonic acid chloride, using pyridine or triethylamine as a deacidifying agent, to produce o-sulfonylaminobenzoic acid ester. If necessary, it is possible to carry out N-alkylation thereof, using an alkylhalide and a strong base such as sodium hydride. The resulting ester is hydrolyzed in the presence of alkali hydroxide to produce a benzoic acid derivative, which is then processed with thionyl chloride and phosphorus ocychloride to produce acid chloride. The resulting acid chloride and the corresponding 2-aminophenol derivative are refluxed in acetonitrile, by which o-sulfonamidobenzoylaminophenol can be synthesized.

In the case of synthesizing 2,5-diacylaminophenol derivatives, a 5-nitro derivative is first synthesized. After the nitro group is reduced to form an amino group, the product is reacted with another acid chloride to produce a coupler.

Examples of synthesis of typical couplers according to the present invention are described below.

Synthesis of
4-chloro-2-(2-dodecan-sulfonamidobenzoylamino) 5-methylphenol: Coupler (1)

1. Synthesis of 2-dodecansulfonamidobenzoyl chloride:

16.5 g of ethyl anthranilate and 22 g of dodecansulfonyl chloride were dissolved in 100 ml of tetrahydrofuran. To the mixture, 17 ml of triethylamine was added dropwise at 50° C. After stirring for 8 hours, 200 ml of ethyl acetate was added, and the mixture was washed with diluted hydrochloric acid and then with water. An oily product obtained by distilling off the solvent in vacuum was dissolved in 100 ml of ethanol, and a solution obtained by dissolving 12 g of sodium hydroxide in 100 ml of water was added thereto. The mixture was stirred at 50° C. for 4 hours. Crystals separated by acidifying with hydrochloric acid after cooling were gathered and washed with water. When dried, 26 g of crystals were obtained. 100 ml of benzene was added to the crystals and 14 ml of thionyl chloride was added dropwise thereto. After heated for 3 hours with refluxing, the solvent and excess thionyl chloride were distilled off in vacuum to produce the desired acid chloride.

2. Synthesis of Coupler (1):

9.4 g of 2-amino-4-chloro-5-methylphenol was dissolved in 120 ml of acetonitrile, and the acid chloride obtained in the first step described above was added dropwise thereto with refluxing. After added dropwise, the mixture was stirred for 3 hours with refluxing. After cooling, ethyl acetate was added and water wash was repeated three times. A residue obtained by distilling off the solvent in vacuum was recrystallized with ethyl acetatehexane to obtain 24 g of crystals having a melting point of 124°-125° C.

Elementary analysis:

Calculated: C 61.34, H 7.33, N 5.50; Found: C 61.00, H 7.46, N 5.50.

Synthesis of
4-chloro-5-[2-(2,4-di-tert-amylphenoxy)-butanamido]-2-(2-methanesulfonamidobenzoylamino)phenol: Coupler (8).

1. Synthesis of 2-methanesulfonamidobenzoyl chloride:

30.2 g of methyl anthranilate was dissolved in a mixture of 50 ml of acetonitrile and 25 ml of pyridine, and 20 ml of methanesulfonyl chloride was added dropwise thereto. After stirring at a room temperature for 2 hours, the mixture was poured into an aqueous mixture of excess hydrochloric acid and ice to form crystals. The resulting crystals were washed with water and dissolved in 100 ml of ethanol. After adding a solution obtained by dissolving 20 g of sodium hydroxide in 100 ml of water, the mixture was stirred at 60° C. for 4 hours. Crystals separated by acidifying with hydrochloric acid were gathered and washed with water. After drying, 39 g of crystals were obtained. To the crystals, 16 ml of benzene was added and 26 ml of thionyl chloride was then added dropwise. After heating for 6 hours under refluxing, the solvent and excess thionyl chloride were removed in vacuum to obtain the desired acid chloride.

2. Synthesis of Coupler (8):

28 g of 2-amino-4-chloro-5-nitrophenol was dissolved in 100 ml of acetonitrile and the acid chloride obtained in the above was added dropwise thereto with refluxing. After adding dropwise, the mixture was stirred for 4 hours with refluxing. After cooling, the separated crystals were gathered to obtain 32 g of the crystals. These crystals were dissolved in 250 ml of isopropanol, and subjected to hydrogenation in an autoclave using a vanadium-carbon catalyst (at 50° C., and an initial hydrogen pressure of 50 kg/cm$^2$). After removed the catalyst by filtration, the solvent with distilled off in vacuum. The residue obtained was dissolved in 200 ml of acetonitrile. 28 g of 2-(2,4-di-tert-amylphenoxy)butanoyl chloride was added dropwise thereto with refluxing. After refluxing for 2 hours, the product was poured into water and extracted with ethyl acetate. After washed with water, the solvent was distilled off in vacuum and the resulting residue was recrystallized with acetonitrilemethanol to obtain 40 g of crystals having a melting point of 199°-201° C.

Elementary analysis:

Calculated: C 62.04, H 6.74, N 6.39; Found: C 62.10, H 6.78, N 6.24.

Photographic emulsion layer or multilayer in the photographic light sensitive materials produced utilizing the coupler(s) of the present invention may contain color image forming couplers other than the couplers of the present invention. It is preferred that these other couplers be nondiffusible ones having a hydrophobic ballast group in the molecule. Also, the other couplers may be 4-equivalent and/or 2-equivalent couplers. Furthermore, the layers may contain colored couplers having a color correction effect or couplers releasing a development inhibitor (a so-called DIR coupler). The other couplers may also be those which form a colorless product by a coupling reaction.

As yellow forming couplers, known ketomethylene type couplers can be used. Among them, benzoylacetanilide type and pivaloylacetanilide type compounds are advantageously used. Examples of the yellow forming couplers capable of being used include those described in U.S. Pat. Nos. 2,875,057, 3,265,506, 3,408,194, 3,551,155, 3,582,322, 3,725,072 and 3,891,445, German Pat. No. 1,547,868, German patent application (OLS) Nos. 2,219,917, 2,261,361 and 2,414,006, British Pat. No. 1,425,020, Japanese patent publication No. 10783/76 and Japanese patent application (OPI) Nos. 26133/72, 73147/73, 102636/76, 6341/75, 123342/75, 130442/75, 21827/76, 87650/75, 82424/77 and 115219/77.

As magenta forming couplers, pyrazolone type compounds, inidazolone type compounds and cyanoacetyl type compounds can be used, and pyrazolone type compounds are particularly advantageous to use. Examples of the magenta forming couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German patent application (OLS) Nos. 2,408,665, 2,417,945, 2,418,959 and 2,424,467, Japanese patent publication No. 6031/65 and Japanese patent application (OPI) Nos. 20826/76, 58922/77, 129538/74, 74027/74, 159336/75, 42121/77, 74028/74, 60233/75, 26541/76 and 55122/78.

As cyan forming couplers, phenol type compounds and naphthol type compounds can be used in addition to the cyan forming couplers of this invention. Examples of them include those described in U.S. Pat. Nos. 2,369,929, 2,434,272, 2,474,293, 2,512,908, 2,895,826, 3,034,892, 3,311,476, 3,458,315, 3,476,563, 3,583,971, 3,591,383, 3,767,411 and 4,004,929, German patent application (OLS) Nos. 2,414,830 and 2,454,329 and Japanese patent application (OPI) Nos. 59838/73, 26034/76, 5055/73, 146828/76, 69624/77 and 90932/77.

As colored couplers, it is possible to use those described, for example, in U.S. Pat. Nos. 3,476,560, 2,521,908 and 3,034,892, Japanese patent publication Nos. 2016/69, 22335/63, 11304/67 and 32461/69, Japanese patent application (OPI) Nos. 26034/76 and 42121/77 and German patent application (OLS) No. 2,418,959.

As DIR couplers, it is possible to use those described, for example, in U.S. Pat. Nos. 3,227,554, 3,617,291, 3,701,783, 3,790,384 and 3,632,345, German patent application (OLS) Nos. 2,414,006, 2,454,301 and 2,454,329, British Pat. No. 953,454, Japanese patent application (OPI) Nos. 69624/77 and 122335/74 and Japanese patent publication No. 16141/76.

The light sensitive materials may contain compounds releasing a development inhibitor other than the DIR couplers. For example, it is possible to use those described in U.S. Pat. Nos. 3,297,445 and 3,379,529, German patent application (OLS) No. 2,417,914 and Japanese patent application (OPI) Nos. 15271/77 and 9116/78.

Two or more of both the couplers of the present invention and the known couplers may be contained in the same layer. The same compound may be contained in two or more layers.

Both the couplers of the present invention and the known couplers are typically added in an amount of from $2\times10^{-3}$ mol to $5\times10^{-1}$ mol, and preferably from $1\times10^{-2}$ mol to $5\times10^{-1}$ mol, per mol of silver in the emulsion layer in which the coupler is contained.

Both the couplers of the present invention and the known couplers are incorporated in the silver halide emulsion layers by known methods, for example, by a method as described in U.S. Pat. No. 2,322,027. For example, they can be dispersed in a hydrophilic colloid after being dissolved in phthalic acid alkyl esters (dibutyl phthalate or dioctyl phthalate, etc.), phosphoric acid esters (diphenyl phosphate, triphenyl phosphate, tricresyl phosphate or dioctylbutyl phosphate), citric acid esters (for example, tributyl acetylcitrate), benzoic acid esters (for example, octyl benzoate), alkylamides (for example, diethyl laurylamide) or aliphatic acid esters (for example, dibutoxyethyl succinate or dioctyl azelate), etc. or organic solvents having a boiling point of from about 30° C. to 150° C. Examples include a lower alkyl acetate such as ethyl acetate or butyl acetate, ethyl propionate, secondary butyl alcohol, methyl isobutyl ketone, $\beta$-ethoxyethyl acetate or methyl cellosolve acetate, etc. The above described high boiling point organic solvents and low boiling point organic solvents may be used as a mixture thereof.

Furthermore, it is possible to use a method of dispersing with using polymers, as described in Japanese patent publication No. 39853/76 and Japanese patent application (OPI) No. 59943/76.

If the couplers have acid groups such as a carboxylic acid group or a sulfonic acid group, they are incorporated in the hydrophilic colloid in the form of an alkaline aqueous solution.

In the light sensitive materials produced by the present invention, the hydrophilic colloid layers may contain an ultraviolet ray absorbing agent. For example, it is possible to use benzotriazole compounds substituted by aryl groups (for example, those described in U.S. Pat. No. 3,533,794), 4-thiazolidone compounds (for example, those described in U.S. Pat. Nos. 3,314,794 and 3,352,681), benzophenone compounds (for example, those described in Japanese patent application (OPI) No. 2784/71), cinnamic acid ester compounds (for example, those described in U.S. Pat. Nos. 3,705,805 and 3,707,375), butadiene compounds (for example, those described in U.S. Pat. No. 4,045,229) and benzoxazole compounds (for example, those described in U.S. Pat. No. 3,700,455). Further, it is possible to use those described in U.S. Pat. No. 3,499,762 and Japanese patent application (OPI) No. 48535/79. Ultraviolet ray absorbing couplers (for example, α-naphthol type cyan dye forming couplers) or ultraviolet ray absorbing polymers may be used, too. These ultraviolet ray absorbing agents may be mordanted in a specified layer.

The photographic emulsions used in the present invention can be prepared by processes as described in *Chimie et Physique Photographique,* by P. Glafkides (published by Paul Montol C., 1967); *Photographic Emulsion Chemistry,* by G. F. Duffin (published by The Focal Press Co., 1966); and *Making and Coating Photographic Emulsion,* by V. L. Zwlikman et al (published by The Focal Press Co., 1964). Namely, any of an acid process, a neutral process and an ammonia process may be used. Further, as a type of reaction of a soluble silver salt with a soluble halogen salt, any of a one-way mixing process, a simultaneous mixing process, or a combination thereof may be used.

It is also possible to use a process of forming particles in a presence of excess silver ions (a so-called reverse mixing process). As one type of the simultaneous mixing process, it is possible to use a process which comprises maintaining a constant pAg of a liquid phase while forming silver halide (the so-called controlled double jet process).

According to this process, silver halide emulsions wherein the crystal form is regular and the particle size is nearly uniform are obtained.

Two or more silver halide emulsions prepared separately may be used as a mixture thereof, if desired.

Cadmium salts, zinc salts, lead salts, thallium salts, iridium salts or complex salts thereof, rhodium salts or complex salts thereof and iron salts or complex salts thereof, etc., may be incorporated in the step of forming silver halide particles or of physical aging.

As a binder or a protective colloid in the photographic emulsions, gelatin is advantageously used, but hydrophilic colloids other than gelatin can also be used. For example, it is possible to use proteins such as gelatin derivatives, graft polymers of gelatin with another high molecular substance, albumin or casein, etc.; saccharides such as cellulose derivatives such as hydroxyethyl cellulose, carboxymethyl cellulose or cellulose sulfate, etc., sodium alginate or starch derivatives, etc.; and various synthetic hydrophilic high molecular materials such as homopolymers or copolymers including polyvinyl alcohol, polyvinyl alcohol semiacetal, poly-N-vinylpyrrolidone, polyacrylic acid, polymethacrylic acid, polyacrylamide, polyvinylimidazole and polyvinylpyrazole, etc.

As the gelatin, not only lime-processed gelatin, but also acid-processed gelatin and enzyme-processed gelatin, as described in *Bull Soc. Sci. Phot. Japan,* No. 16, page 30 (1966) may be used. Further, hydrolysis products and enzymatic decomposition products of gelatin can be used, too. As gelatin derivatives, it is possible to use those which are obtained by reacting gelatin with various compounds, for example, acid halides, acid anhydrides, isocyanates, bromoacetic acid, alkane sultones, vinyl sulfonamides, maleinimide compounds, polyalkylene oxides and epoxy compounds, etc. Examples of them have been described in U.S. Pat. Nos. 2,614,928, 3,132,945, 3,186,846 and 3,312,553, British Pat. Nos. 861,414, 1,033,189 and 1,005,784 and Japanese patent publication No. 26845/67, etc.

As the graft polymers of gelatin, it is possible to use those obtained by grafting gelatin with homo- or copolymers of vinyl monomers such as acrylic acid, methacrylic acid and derivatives thereof such as esters or amides, etc., acrylonitrile or sytrene, etc. Particularly, it is preferred to use graft polymers of gelatin with polymers having a some degree of compatibility with gelatin, for example, polymers of acrylic acid, methacrylic acid, acrylamide, methacrylamide or hydroxyalkyl methacrylate, etc. Examples thereof have been described in U.S. Pat. Nos. 2,763,625, 2,831,767 and 2,956,884.

Typical examples of the synthetic high molecular materials are those described in German patent application (OLS) No. 2,312,708, U.S. Pat. Nos. 3,620,751 and 3,879,205 and Japanese patent publication No. 7561/68.

For the purpose of preventing fogging in the step of producing light sensitive materials, during preservation or during photographic processing or to stabilize photographic properties, it is possible to add various compounds to the photographic emulsions used in the present invention. Namely, it is possible to add many compounds known as antifogging agents or stabilizing agents such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazole and mercaptotetrazoles (particularly, 1-phenyl-5-mercaptotetrazole), etc.; mercaptopyrimidines; mercaptotriazines; thioketo compounds such as oxazoline thione; azaindenes, for example, triazaindenes, tetrazaindenes (particularly, 4-hydroxy substituted-(1,3,3a,7)-tetrazaindenes) and pentazaindenes, etc.; benzenethiosulfonic acids, benzenesulfinic acids and benzenesulfonic acid amides, etc. For example, it is possible to use compounds as described in U.S. Pat. Nos. 3,954,474 and 3,982,947 and Japanese patent publication No. 28660/77.

For the purpose of increasing sensitivity, increasing contrast, or accelerating development, the photographic emulsion layers of the photographic light sensitive materials of the present invention may contain, for example, polyalkylene oxide or derivatives thereof such as ethers, esters or amines, etc., thio ether compounds, thiomorpholinic acid, quaternary ammonium salts, urethane derivatives, urea derivatives, imidazole derivatives and 3-pyrazolidones, etc. For example, it is possible to use compounds as described in U.S. Pat. Nos. 2,400,532, 2,423,549, 2,716,062, 3,617,280, 3,772,021 and 3,808,003 and British Patent 1,488,991, etc., for these purpose also.

The photographic emulsions used in the present invention may be spectrally sensitized with methine dyes or others. The dyes used include cyanine dyes, merocyanine dyes, compound cyanine dyes, compound merocyanine dyes, holopolar cyanine dyes, hemicyanine dyes, styryl dyes and hemioxonol dyes. Particularly suitable dyes are dyes belonging to cyanine dyes, merocyanine dyes and compound merocyanine dyes. These dyes may have as a basic heterocyclic nucleus any of nuclei utilized generally for cyanine dyes. Namely, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus, etc.; nuclei wherein an alicyclic hydrocarbon ring is condensed with the above described nuclei; and nuclei wherein an aromatic hydrocarbon ring is condensed with the above described nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus, etc. These nuclei may have substituents on the carbon atoms.

In the merocyanine dyes and the compound merocyanine dyes, it is possible to utilize as a nucleus having ketomethylene structure, a 5- or 6-membered heterocyclic nucleus such as a pyrazolin-5-one nucleus, a thiohydantoin nucleus, a 2-thioxazolindine-2,4-dione nucleus, a thiazolidine-2,4-dione nucleus, a rhodanin nucleus or a thiobarbituric acid nucleus, etc.

Examples of useful sensitizing dyes are those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent 1,242,588 and Japanese patent publication Nos. 14030/69 and 24844/77.

These sensitizing dyes can be used alone, or they may be used as a combination thereof. The combinations of the sensitizing dyes are often used for, particularly, the purpose of supersensitization. Typical examples of them have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese patent publication Nos. 4936/68 and 12375/78 and Japanese patent application (OPI) Nos. 110618/77 and 109925/77.

The emulsions may contain dyes which do not have a spectral sensitization function themselves or substances which do not substantially absorb visible rays, but show a supersensitization function, together with the sensitizing dyes. For example, they may contain aminostilbene compounds substituted with a nitrogen containing heterocyclic group (for example, U.S. Pat. Nos. 2,933,390 and 3,635,721), aromatic organic acid-formaldehyde condensates (for example, U.S. Pat. No. 3,743,510), cadmium salts or azaindene compounds, etc. Combinations described in U.S. Pat. Nos. 3,615,613, 3,615,641, 3,617,295 and 3,635,721 are particularly preferred.

In the light sensitive materials produced with utilizing the present invention, the hydrophilic colloid layers may contain water soluble dyes as filter dyes or for the purpose of preventing irradiation or others. Such dyes include oxonol dyes, hemioxonol dyes, styryl dyes, merocyanine dyes, cyanine dyes and azo dyes. Particularly, oxonol dyes, hemioxonol dyes and merocyanine dyes are preferred. Examples of such dyes capable of being used include those described in British Pat. Nos. 584,609 and 1,177,429, Japanese patent application (OPI) Nos. 85130/73, 99620/74, 114420/74 and 108115/77 and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In the light sensitive materials produced with utilizing the present invention, photographic emulsion layers and other hydrophilic colloid layers may contain whitening agents such as stilbene, triazine, oxazole or coumarin type whitening agents. These whitening agents may be soluble in water. In the case of water insoluble whitening agents, they may be used as a dispersion. Examples of fluorescent whitening agents have been described in U.S. Pat. Nos. 2,632,701, 3,269,840 and 3,359,102 and British Pat. Nos. 852,075 and 1,319,763, etc.

When the present invention is carried out, known antifading agents may be used therewith. Furthermore, the color image stabilizers may be used in the light sensitive materials according to the present invention, alone or as a mixture of two or more of them. The antifading agents include, for example, hydroquinone derivatives as described in U.S. Pat. Nos. 2,360,290, 2,418,613, 2,675,314, 2,701,197, 2,704,713, 2,728,569, 2,732,300, 2,735,765, 2,710,801 and 2,816,028 and British Pat. No. 1,363,921, etc., gallic acid derivatives as described in U.S. Pat. Nos. 3,457,079 and 3,069,262, etc., p-alkoxyphenols as described in U.S. Pat. Nos. 2,735,765 and 3,698,909 and Japanese patent publication Nos. 20977/74 and 6623/77, p-oxyphenol derivatives as described in U.S. Pat. Nos. 3,432,300, 3,573,050, 3,574,627 and 3,764,337 and Japanese patent application (OPI) Nos. 35633/77, 147434/77 and 152225/77, and bisphenols as described in U.S. Pat. No. 3,700,455.

The light sensitive materials according to the present invention may contain hydroquinone derivatives, aminophenol derivatives, gallic acid derivatives or ascorbic acid derivatives as anti-color-fogging agents. Examples thereof are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese patent application (OPI) Nos. 92988/75, 92989/75, 93928/75, 110337/75 and 146235/77 and Japanese patent publication No. 23813/75, etc.

The present invention can be applied to multilayer multicolor photographic materials comprising layers of at least two different spectral sensitivities on a base. The multilayer technicolor photographic materials generally have at least a red-sensitive emulsion layer, a green-sensitive emulsion layer, and a blue-sensitive emulsion layer on a base. The order of these layers can be suitably selected as occasion demands. Generally, the red-sensitive emulsion layer contains a cyan forming coupler, the green-sensitive emulsion layer contains a magenta forming coupler, and the blue-sensitive emulsion layer contains a yellow forming coupler, but other combinations can be adopted if desired.

In the photographic light sensitive materials produced according to the present invention, the photographic emulsion layers and other layers are produced by applying to a flexible base, such as conventionally used plastic films, paper or cloth, etc. or rigid bases such as glass, porcelain or metal, etc. As useful elastic bases, there are films composed of semisynthetic or synthetic high molecular materials such as cellulose nitrate, cellulose acetate, cellulose acetate butyrate, polystyrene, polyvinyl chloride, polyethylene terephthalate or polycarbonate, etc. and papers to which a baryta layer or α-olefin polymer (for example, polyethylene, polypropylene or ethylene-butene copolymer) is applied or laminated. The bases may be colored with dyes or pigments. In order to intercept light, the bases may be blackened. The surface of these bases is generally subjected to an undercoating treatment in order to improve adhesion to the photographic emulsion layer, etc. The surface of the bases may be subjected to corona discharging, ultraviolet ray application or flame treatment etc. before or after the undercoating treatment. Further, the present invention can be used for color light sensitive materials comprising a layer having low oxygen permeability (for example, a layer composed of polyvinyl alcohol or homopolymer or copolymer of acrylonitrile, etc.) between the base and the photographic emulsion.

Photographic processing of the light sensitive materials of the present invention can be carried out by known processes. Known processing solutions can be used. The processing temperature is generally selected from the range from 18° C. to 50° C., but a temperature lower than 18° C. or a temperature higher than 50° C. may be used. Known development processes for forming silver images (black-white photographic processing) and development processing for forming dye images may be adopted as the color photographic processing, according to the particular purpose.

The color developing solution generally consists of an alkaline aqueous solution containing a color developing agent. As the color developing agent, it is possible to use known primary aromatic amine developing agents, for example, phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.).

In addition, compounds described in *Photographic Processing Chemistry,* pages 226 to 229, by L. F. A. Mason (published by Focal Press, 1966), U.S. Pat. Nos. 2,193,015 and 2,592,364 and Japanese patent application (OPI) No. 64933/73, etc. may be used, too.

The color developing solution is capable of containing pH buffers such as sulfites, carbonates, borates or phosphates of alkali metals, and development restrainers or antifogging agents such as bromides, iodides or organic antifogging agents. Furthermore, if desired, the solution may contain water softeners, preservatives such as hydroxylamine, organic solvents such as benzyl alcohol or diethylene glycol, development accelerators such as polyethylene glycol, quaternary ammonium salts or amines, dye forming couplers, competition couplers, fogging agents such as sodium borohydride, auxiliary developing agents such as 1-phenyl-3-pyrazolidone, viscosity-imparting agents, polycarboxylic acid chelating agents as described in U.S. Pat. No. 4,083,723 and antioxidants as described in German patent application (OLS) No. 2,622,950, etc.

The photographic emulsion layers after color development are generally subjected to bleaching. The bleaching may be carried out simultaneously with fixing or may be carried out respectively. As bleaching agents, compounds of polyvalent metals such as iron (III), cobalt (IV), chromium (VI) or copper (II), etc., peracids, quinones and nitroso compounds are used. For example, it is possible to use ferricyanides, bichromates, organic complex salts of iron (III) or cobalt (III) and complex salts of aminopolycarboxylic acids such as ethylenediaminetetraacetic acid, nitrilotriacetic acid or 1,3-diamino-2-propanol tetraacetic acid, etc. or organic acids such as citric acid, tartaric acid or malic acid, etc.; persulfates and permanganates; and nitrosophenol, etc. Among them, potassium ferricyanide, sodium (ethylenediaminetetraacetato) iron (III) complex and ammonium (ethylenediaminetetraacetato) iron (III) complex are particularly useful. (Ethylenediaminetetraacetato) iron (III) complex salts are useful for both a bleaching solution or a one-bath bleach-fixing solution.

To the bleaching solution or the bleach-fixing solution, it is possible to add various additives in addition to bleaching accelerators as described in U.S. Pat. Nos. 3,042,520 and 3,241,966 and Japanese patent publication Nos. 8506/70 and 8836/70, etc. and thiol compounds described in Japanese patent application (OPI) No. 65732/78.

In the following, the present invention is illustrated in detail by examples, but the invention is not limited thereto.

EXAMPLE 1

A solution obtained by heating 25 g of Coupler (1): 4-chloro-2-(2-dodecanesulfonamidobenzoylamino)-5-methylphenol, 25 g of trioctyl phosphate and 50 ml of ethyl acetate to 50° C. was added to 250 ml of an aqueous solution containing 25 g of gelatin and 1.0 g of sodium dodecylbenzenesulfonate. The mixture was stirred and allowed to pass 5 times through a colloid mill after heated previously, by which the mixture was finely dispersed to obtain an emulsion.

The whole of this emulsion was added to 1.0 kg of a photographic emulsion containing 54 g of silver iodobromide and 60 g of gelatin. After 80 ml of a 2% aqueous solution of 4,6-dichloro-4-hydroxytriazine as a hardening agent was added, a pH of the dispersion mixture was adjusted to 6.0 and the mixture was applied to a cellulose triacetate film base so as to obtain a dry film thickness of 7.0 microns. The resulting film was designated as Sample A.

Films were prepared by the same procedure as described above, except using equimolar amounts of Couplers (4), (8), (10) and (12) instead of the above described Coupler (1). These films were designated as Samples B, C, D and E, respectively.

For purposes of comparison, films were prepared by the same procedure as described above, except using an equimolar amount of Couplers (101), (102), (103), (104) and (105) as described below instead of the above described Coupler (1). These films were designated as Samples F, G, H, I and J.

Comparative Coupler (101)

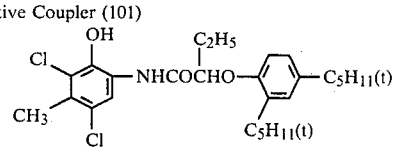

Comparative Coupler (102)

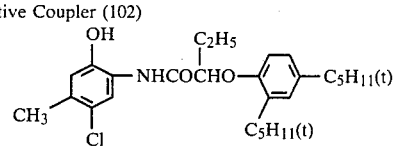

Comparative Coupler (103)

-continued

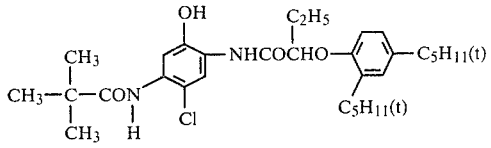

Comparative Coupler (104)

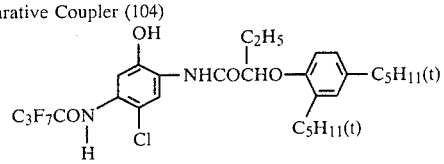

Comparative Coupler (105)

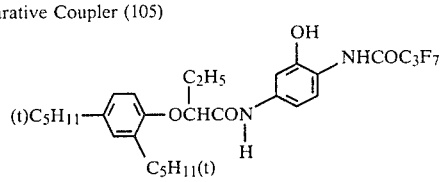

These films were subjected to a continuous exposure by means of a sensitometric wedge and processed thereafter as follows.

| Color development step | | |
|---|---|---|
| 1. Color development | 33° C. | 3.5 minutes |
| 2. Bleach-fixation | 33° C. | 1.5 minutes |
| 3. Water wash | 25 to 30° C. | 2.5 minutes |

The composition of each processing solution for the color development step was as follows

| | |
|---|---|
| Color developing solution: | |
| Benzyl alcohol | 15 ml |
| Diethylene glycol | 8 ml |
| Ethylenediaminetetraacetic acid | 5 g |
| Sodium sulfite | 2 g |
| Anhydrous potassium carbonate | 30 g |
| Hydroxylamine sulfate | 3 g |
| Potassium bromide | 0.6 g |
| 4-Amino-N-ethyl-N-(β-methanesulfonamidoethyl)-m-toluidine sesquisulfate monohydrate | 5 g |
| Water | to make 1 liter pH 10.2 |
| Bleach-fixing solution: | |
| Ethylenediaminetetraacetic acid | 2 g |
| (Ethylenediaminetetraacetato) iron (III) complex | 40 g |
| Sodium sulfite | 5 g |
| Ammonium thiosulfate | 70 g |
| Water | to make 1 liter |

When absorption spectra of the resulting samples after processing were measured, the results shown in Table 1 were obtained.

TABLE 1

| Film sample | Coupler | Absorption maximum mμ | Half width of absorption mμ |
|---|---|---|---|
| A | (1) (this invention) | 646 | 136 |
| B | (4) (this invention) | 650 | 138 |
| C | (8) (this invention) | 651 | 136 |
| D | (10) (this invention) | 646 | 134 |
| E | (12) (this invention) | 648 | 132 |
| F | (101) (comparison) | 649 | 138 |
| G | (102) (comparison) | 625 | 138 |
| H | (103) (comparison) | 626 | 136 |

TABLE 1-continued

| Film sample | Coupler | Absorption maximum mμ | Half width of absorption mμ |
|---|---|---|---|
| I | (104) (comparison) | 632 | 132 |
| J | (105) (comparison) | 658 | 137 |

As is seen from this Table, the couplers of this invention form dyes having absorption maximum in the range of 645 to 655 mμ which is suitable for color reproduction.

Then, the fastness to light and heat of each film after development was examined. Fastness to heat was determined by allowing the film to remain at 100° C. for 6 days in the dark, and by allowing the film to remain at 60° C. and 70% RH for 6 weeks in the dark, and fastness to light was determined by exposing the film to light for 6 days by means of a xenon tester (100,000 lux). The results are described in Table 2 as reduction ratios of the density based on an initial density of 1.0.

TABLE 2

| Film Sample | Coupler | 100° C., for 6 days | 60° C., 70% RH, for 6 weeks | Light (xenon), for 6 days |
|---|---|---|---|---|
| A | (1) (this invention) | 22% | 4% | 12% |
| B | (4) (this invention) | 18% | 3% | 12% |
| C | (8) (this invention) | 2% | 3% | 15% |
| D | (10) (this invention) | 2% | 1% | 7% |
| E | (12) (this invention) | 11% | 6% | 13% |
| F | (101) (comparison) | 79% | 8% | 18% |
| G | (102) (comparison) | 38% | 7% | 28% |
| H | (103) (comparison) | 10% | 9% | 29% |
| I | (104) (comparison) | 13% | 9% | 50% |
| J | (105) (comparison) | 16% | 12% | 38% |

As is clear from Table 2, Comparative Coupler (101) which has the absorption maximum suitable for color reproduction (as shown in Table 1) is inferior in fastness to heat and Comparative Coupler (105) is inferior in fastness to light. On the other hand, Comparative Couplers (102), (103) and (104) which are relatively excellent in fastness of color images are not suitable for color reproduction because of having absorptions at shorter wavelengths. On the contrary, the couplers of the present invention not only have a suitable absorption maximum but also are excellent in fastness to both of light and heat.

While the invention has been described in detail and with reference to specific embodiments thereof, it will be apparent to one skilled in the art that various changes and modifications can be made therein without departing from the spirit and scope thereof.

What is claimed is:

1. A color photographic silver halide light sensitive material comprising a cyan dye forming coupler represented by formula (I)

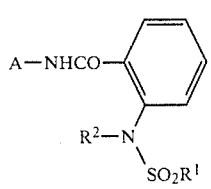

(I)

wherein A represents a cyan coupler residue, but the —NHCO group does not bond to A in the active position of A, $R^1$ represents a substituted or unsubstituted alkyl group or aryl group, $R^2$ represents hydrogen or a substituted or unsubstituted alkyl group, and the various positions of the phenyl group of the formula (I) may be substituted with from 1 to 3 substituents selected from the group consisting of hydrogen, a halogen atom, an alkyl group, or an alkoxy group.

2. A color photographic light sensitive material as in claim 1, wherein $R^1$ represents a substituted or unsubstituted alkyl group having from 1 to 22 carbon atoms or a substituted or unsubstituted aryl group having from 6 to 22 carbon atoms; $R^2$ represents hydrogen or a substituted or unsubstituted alkyl group having from 1 to 22 carbon atoms; and the various positions of the phenyl group of the formula (I) may be substituted with from 1 to 3 substituents selected from the group consisting of hydrogen, a halogen atom, an alkyl group having from 1 to 22 carbon atom or an alkoxy group.

3. A color photographic light sensitive material as in claim 2, wherein $R^1$ is a methyl group, a butyl group, a methoxyethyl group, a dodecyl group, a phenoxypropyl group, a p-chlorophenoxybutyl group, a p-tolyl group, a p-dodecylphenyl group, a p-chlorophenyl group, or a naphthyl group; and $R^2$ is a methyl group, a butyl group, an octyl group, a hexadecyl group, a 2-chloroethyl group, or a 2-methoxyethyl group.

4. A color photographic light sensitive material as in claim 1, 2 or 3, wherein the substituents of the alkyl groups and aryl groups represented by $R^1$ and $R^2$ are selected from a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, an acyloxy group, a sulfamoyl group, a carbamoyl group, an acylamino group, a diacylamino group, a ureido group, an arylamino group, an N-alkylanilino group, an N-acylanilino group, a hydroxy group, and a mercapto group.

5. A color photographic light sensitive material as in claim 1, 2 or 3, wherein A represents a phenol cyan coupler residue represented by formula (II)

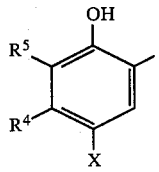

(II)

wherein $R^4$ represents a substituted or unsubstituted alkyl group, alkylacylamino group, or arylacylamino group; $R^5$ represents hydrogen or a halogen atom; and X represents a group capable of being released by an oxidation coupling reaction with a developing agent.

6. A color photographic light sensitive material as in claim 4, wherein A represents a phenol cyan coupler residue represented by formula (II)

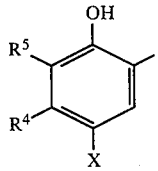

(II)

wherein $R^4$ represents a substituted or unsubstituted alkyl group, alkylacylamino group, or arylacylamino group; $R^5$ represents hydrogen or a halogen atom; and X represents a group capable of being released by an oxidation coupling reaction with a developing agent.

7. A color photographic light sensitive material as in claim 5, wherein $R^4$ is a substituted or unsubstituted alkylacylamino group; and $R^5$ is hydrogen.

8. A color photographic light sensitive material as in claim 5, wherein the substituents of $R^4$ are selected from a halogen atom, a nitro group, a cyano group, aryl group, an alkoxy group, an aryloxy group, a carboxy group, an alkylcarbonyl group, an arylcarbonyl group, an alkoxycarbonyl group, an aryloxycarbonyl group, an acyloxy group, a sulfamoyl group, a carbamoyl group, an acylamino group, a diacylamino group, a ureido group, an arylamino group, an N-alkylanilino group, an N-acylanilino group, a hydroxy group, and a mercapto group.

9. A color photographic light sensitive material as in claim 5, wherein X represents hydrogen, a halogen atom, an alkoxy group, an aryloxy group, an acyloxy group, an imido group, a sulfonamido group or a thiocyano group.

10. A color photographic light sensitive material as in claim 5, wherein $R^4$ is an alkyl group selected from a methyl group, an ethyl group, a butyl group, a pentadecyl group, a phenylthiomethyl group, and a chloromethyl group, or an alkylacylamino group selected from a butyrylamino group, a pivaloylamino group and a 2-(2',4'-di-tert-amylphenoxy)butanamido group or the arylacylamino group of $R^4$ represents a benzoylamino group.

11. A color photographic light sensitive material as in claim 1, 2, 3, 4, 5, 6, 7, 8, 9 or 10, wherein the cyan dye forming coupler represented by formula (I) is present in a red-sensitive layer.

* * * * *

UNITED STATES PATENT AND TRADEMARK OFFICE

Certificate

Patent No. 4,334,011 Patented June 8, 1982

Kozo Aoki, Yoshio Seoka, Yukio Yokota

Application having been made by Kozo Aoki, Yoshio Seoka, and Yukio Yokota, the inventors named in the patent above identified, and Fuji Photo Film Co., Ltd., the assignee, for the issuance of a certificate under the provisions of Title 35, Section 256, of the United States Code, deleting the name of Yukio Yokota as a joint inventor, and a showing and proof of facts satisfying the requirements of the said section having been submitted, it is this 25th day of Sept. 1984, certified that the name of the said Yukio Yokota is hereby deleted from the said patent as a joint inventor with the said Kozo Aoki and Yoshio Seoka.

Fred W. Sherling,
*Associate Solicitor.*